US005636774A

United States Patent [19]

Moscato

[11] Patent Number: 5,636,774

[45] Date of Patent: Jun. 10, 1997

[54] AUTOMATIC DEVICE THAT MAY BE INDEPENDENTLY MANAGED BY UNABLE PERSONS FOR WEARING SOCKS AND SIMILAR ARTICLES

[76] Inventor: Giuseppe Moscato, via G. Carini, 25-I-00152, Roma, Italy

[21] Appl. No.: 464,749

[22] PCT Filed: Dec. 29, 1993

[86] PCT No.: PCT/IT93/00140

§ 371 Date: Jun. 22, 1995

§ 102(e) Date: Jun. 22, 1995

[87] PCT Pub. No.: WO95/14414

PCT Pub. Date: Jun. 1, 1995

[30] Foreign Application Priority Data

Nov. 23, 1993 [IT] Italy ..... RM93A0774

[51] Int. Cl.[6] ..... A47G 25/90

[52] U.S. Cl. ..... 223/112; 223/111

[58] Field of Search ..... 223/111, 112, 223/114, 120, 118

[56] References Cited

U.S. PATENT DOCUMENTS

| | | | |
|---|---|---|---|
| 3,727,812 | 4/1973 | Weiss . | |
| 3,883,052 | 5/1975 | Wilson | 223/111 |
| 3,970,117 | 7/1976 | Zamansky | 140/93 |
| 3,993,228 | 11/1976 | Fuhr | 223/111 |
| 4,072,255 | 2/1978 | Bogorad . | |
| 4,238,061 | 12/1980 | Marchetti | 223/111 |
| 4,892,239 | 1/1990 | Tomasi | 223/111 |
| 5,050,783 | 9/1991 | Hunter | 223/111 |
| 5,222,973 | 6/1993 | Sharpe et al. | 294/99.2 |
| 5,249,720 | 10/1993 | White . | |
| 5,303,856 | 4/1994 | Weatherbolt, Sr. | 223/111 |

FOREIGN PATENT DOCUMENTS

| | | |
|---|---|---|
| 2316903 | 2/1977 | France . |
| 6910686 | 1/1971 | Netherlands . |

*Primary Examiner*—Bibhu Mohanty

*Attorney, Agent, or Firm*—Beveridge, DeGrandi, Weilacher & Young, L.L.P.

[57] ABSTRACT

The device according to the present invention consists of a means (1) having wings that may be outwardly projected and that may be inserted into a sock or similar, overcoming its resistance and keeping it wide enough to allow to insert a foot so that, following to the manual traction or of an electric motor (9), performed by means of a small rod (7) linked with said means (1), the unable person obtains the complete wearing of the cloth without folding his limbs nor himself.

1 Claim, 2 Drawing Sheets

AUTOMATIC DEVICE THAT MAY BE INDEPENDENTLY MANAGED BY UNABLE PERSONS FOR WEARING SOCKS AND SIMILAR ARTICLES

The present invention concerns an automatic device that may be used by persons, like those handicapped in their lower limbs or obese persons, for whom it is impossible to independently put on stockings, socks or similar articles.

Furthermore, the device according to the present invention may also be used by persons handicapped in their upper limbs who are able to grasp the device and push an operating switch.

It is well known that above mentioned persons, who are unable to independently put on footwear beyond other limitations, need the help of other persons who are not always available.

At present, an instrument is known in the prior art for above mentioned function, consisting of a continuous structure having an approximately semicircular band on the edge of which the top of an elastic sock may be manually put on and then, by pulling a handle, worn.

The device is not very practical and can be used only by persons who have a good control of their arms and with socks having a wide upper opening, as the semicircular structure can not easily be housed—due to its relevant dimensions—inside the narrow bands of modern footwear products.

It is the aim of the present invention to make persons, independently able to perform the above mentioned function.

The aim set forth is reached by means of the device consisting of a winged portion that may be widened into an open state. The winged portion can be inserted into any kind of sock or similar, article elastic or not, overcoming its resistance when widened and keeping the sock wide enough to allow insertion of a foot inside. Following the activation—manual or performed by a small electric motor—effected with the help of a small rod linked to the winged portion, the user is able to put on the clothes without bending.

The winged portion may be preferrably realized with the structure of a wheel belt consisting of elements provided with rests, so that following to the widening activation performed by an electric motor housed in the top of said small rod and by means of the sliding of a harmonic steel thread or similar device, the said elements open projecting end wings and widen the sock according to the aim set forth in the present invention.

Furthermore, said means having the structure of a wheel belt is folded, in its start position, to a minimum so as to be put away or easily inserted into a sock.

BRIEF DESCRIPTION OF THE DRAWINGS

The present invention will be described more in detail hereinbelow with reference to the enclosed drawings in which.

DETAILED DESCRIPTION OF THE DRAWINGS

Figure 1:
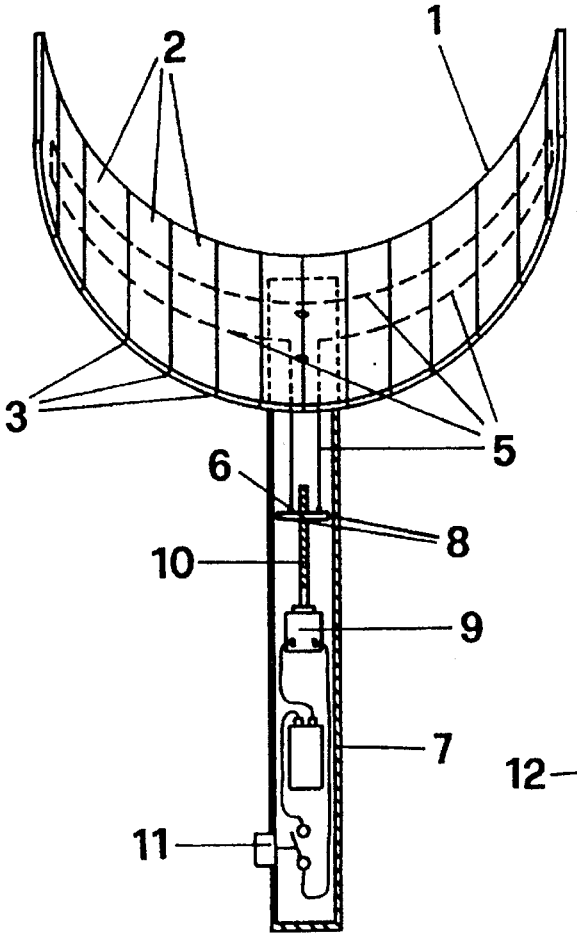
FIG. 1 shows an axonometric scheme of an automatic device, self-managed by persons severely unable to independently put on stockings, socks and similar articles.

The enclosed figures show an automatic device, self-managed by persons, otherwise unable to put on stockings, socks and similar articles, consisting of:

- a widening means 1, that may be inserted into the socks for allowing insertion of the foot, comprising a plurality of elements 2 having the structure of a wheel belt and the approximate shape of a half-circle due to the presence of rest hinges 3 when said elements 2 are pushed outwards under the force of the harmonic steel thread 5 or similar device;
- a harmonic steel thread 5 or similar device sliding due to traction so as to push elements 2 outwards until the rests so as to activate the widening of the end wings of said means 1;
- a means for pulling said thread 5 comprising the transversal small rod 6 linked to the ends of said thread 5, the ends whereof are forced to slide along the small rod 7 through parallel guides 8;
- a transmission means for the motion with an operating switch 11, comprising an electric motor 9 linked to the top of said small rod 7 that puts into rotation the endless screw 10 that causes the lifting, along said small rod 7, of said transversal rest 6 and therefore the traction of the thread S and the consequent widening of the means 1, according to the aim set forth.

All above mentioned elements may be realized with appropriate metal or plastic, light and functional materials.

Figure 2:
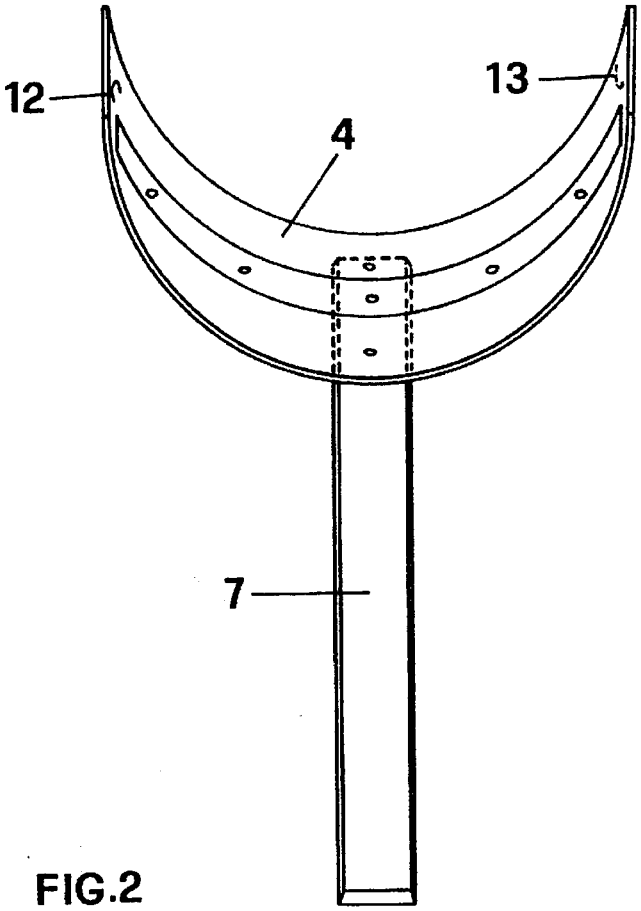
FIG. 2 shows a simplified variant of the device according to the present invention for persons disabled only in their lower limbs and provided with a nearly normal upper torso.

In the variant according to FIG. 2, the widening means 4 is preferably realized with a continuous structure and with an elastic blade with a half-circle shape, that may be closed again due to a manual striction until the hooking with end means 12 and 13 is reached, so as to form a complete circle, inserted into the sock that will be widened following to the unhoking and put onto the foot by manual traction of the small rod 7.

Figure 3:
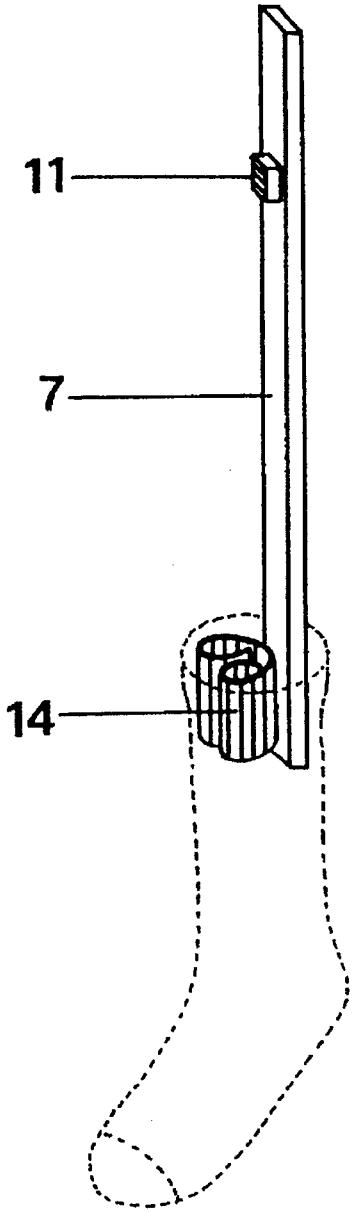
FIGS. 3 and 4 show the operative stages of the insertion of the device according to the present invention into a sock and the successive widening of the same for insertion on the foot.
Figure 4:
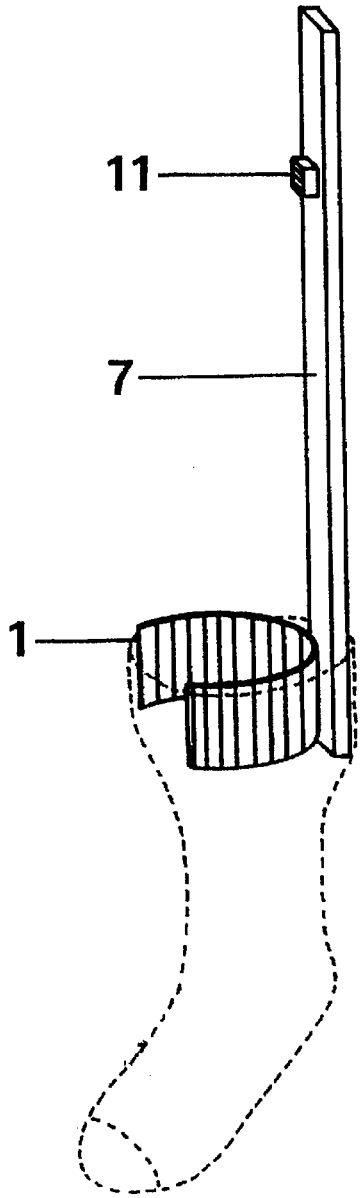

It shall be emphasized, with additional reference to FIGS. 3 and 4 that said wheel blade means 1 and said elastic means 4 form, when folded, a compact structure 14 occupying a minimum space and, therefore, may be easily inserted into a sock, having even a very narrow opening. Further the automatic opening of wheel blade 1 or the release opening of elastic means 4 provides a wide and automatic opening of a sock, thus facilitating the placement operation.

I claim:

1. An automatic device to assist persons unable to put on socks and similar footwear, comprising:

a widening portion having a plurality of elements and a plurality of rest hinges said plurality of elements being interconnected by said plurality of rest hinges and forming a wheel blade when in an open positions;

a thread capable of sliding due to traction so as to make said elements project until said widening portion is in open position;

means for pulling said thread including a transversal rest linked with the ends of said thread, a small rod and a pair of parallel guides;

means for transmitting force to said means for pulling said thread including an activation switch, an electric motor linked with the top of said small rod, and a screw, said transmitting means determining the lifting, along said small rod of said transversal rest, and therefore, the traction of said thread and the projection of said widening portion in said open position.

* * * * *